US005249984A

United States Patent [19]

Antonini et al.

[11] Patent Number: 5,249,984

[45] Date of Patent: Oct. 5, 1993

[54] FILTER ADAPTER FOR PANEL MOUNTED CONNECTORS

[75] Inventors: Gino Antonini, Pelham; David I. Weinstein, Yorktown Hts., both of N.Y.

[73] Assignee: Kings Electronics Co., Inc., Tuckahoe, N.Y.

[21] Appl. No.: 998,011

[22] Filed: Dec. 29, 1992

[51] Int. Cl.[5] ..... H01R 13/66

[52] U.S. Cl. ..... 439/620; 333/182

[58] Field of Search ..... 439/620; 333/181-185

[56] References Cited

U.S. PATENT DOCUMENTS

| | | | |
|---|---|---|---|
| 4,229,714 | 10/1980 | Yu | 333/181 |
| 5,032,091 | 7/1991 | Itikuff | 439/620 |
| 5,192,230 | 3/1993 | Gabany et al. | 439/620 |

*Primary Examiner*—Gary F. Paumen

*Attorney, Agent, or Firm*—Jordan B. Bierman

[57] ABSTRACT

An adapter including a front and rear conductive portion separated by a filter device and a non-conductive support, through which an RF-type cable connector can be inserted and mounted on a receiving connector on an external device. Because the conductive portions of the adapter are isolated from the panel by means of the disc capacitor, all DC ground currents are prevented from passing through the filtering device, effectively isolating the shell of the panel on which it is mounted, while all AC currents are passed through the filtering device to the panel on which it is mounted, effectively grounding any undesired radiating signals and preventing interference. The adapter can be supplied as a single unit which is simply inserted over the connector body before panel mounting.

6 Claims, 1 Drawing Sheet

FILTER ADAPTER FOR PANEL MOUNTED CONNECTORS

The present invention is directed to an electrical adapter and, more specifically, to an adapter provided with an appropriate filtering device which electrically decouples a coaxial radio frequency (RF) panel connector from the chassis of an external device on which it is mounted.

BACKGROUND OF THE INVENTION

A typical RF-type cable, including coaxial, twinaxial, and triaxial cable, comprises at least one inner conductive wire, a surrounding conductor (braid), a dielectric insulating layer disposed between the conductor and the braid, and an outer insulating jacket. Such cables are usually connected to devices using connector assemblies crimped or soldered onto the cable end. The RF connector is screwed onto a metal panel and is mated to a receiving connector. With the above arrangement, however, it was found that electrical noise could pass directly into the connector shell from the metal panel, causing interference. It was therefore advantageous to provide a filter adapter which could be inserted between the cable/connector assembly and the mounting chassis of the device to which it is attached to filter out the electrical noise and provide DC isolation.

One device for doing the forgoing is described in U.S. Pat. No. 5,032,091. The adapter described therein includes an insulating, three shouldered gasket having a small capacitor disposes in a channel formed therein. The gasket isolates the electrical connector from the receiving connector so that all ground currents transferred between the electrical connector and the receiving panel can only pass through the filter. It was found, however, with this apparatus that, due to the small contact area of the filtering device with the connector and panel, the filter could not operate at frequencies above 300 Mhz. In addition, the apparatus required that the small capacitor be epoxied into the housing, resulting in a significant increase in assembly time and a higher failure rate.

BRIEF DESCRIPTION OF THE INVENTION

In view of the foregoing, it is an object of the present invention to provide a filter adapter which is inserted between the cable/connector assembly and mounting chassis of the device to which it is attached which can be assembled easily, is mechanically reliable, and filters electric interference over a wide bandwidth. It is a further object of the invention to provide a filtering adapter which can compensate for dimensional tolerances in the connector body. Other objects and features of the invention will become apparent from the following detailed description considered in conjunction with the accompanying drawings.

DETAILED DESCRIPTION OF THE INVENTION

Figure 1:
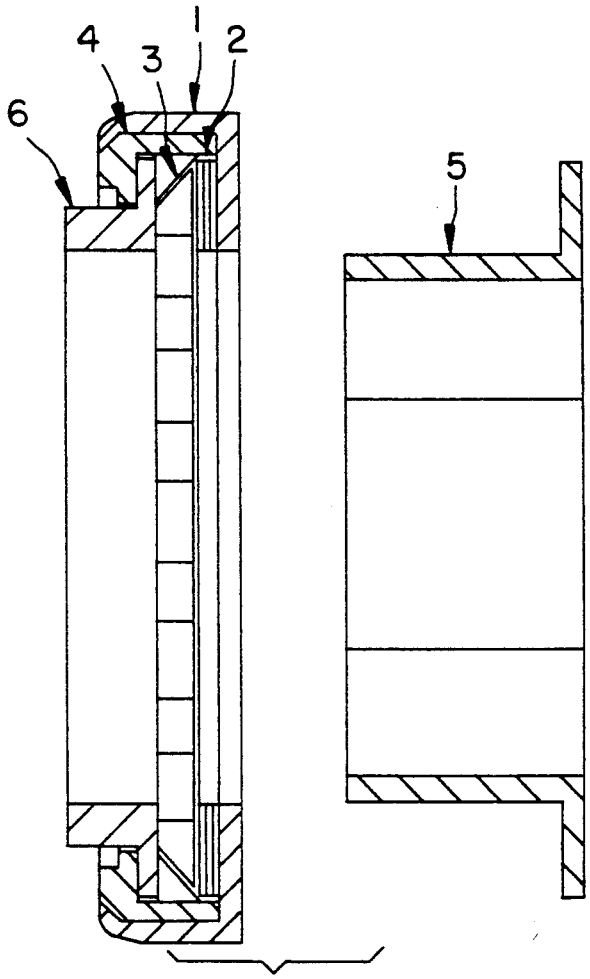
FIG. 1 is a side section view of the inventive adapter.

A standard connector comprises a metal outer body formed with a body flange which rests against the chassis of the external device to which the connector is connected. This body flange is usually supplied with an annular ring provided with an O-ring which is pressed between the flange and the chassis. Within the flange there is a threaded section having a flattened portion that fits into a prepared hole in the mounting panel of the chassis. When installed, the connector is held in place by a lock washer and nut installed from behind the panel.

The inventive adapter, as shown in FIG. 1, fits over the threaded portion of the body flange so that it is positioned between the flange of the connectors metal outer body and the chassis of the external device. The inventive adapter comprises conductive front filter housing 1 having a first surface adapted to contact the chassis of the external device, and a second surface. Filtering device 2 contacts the second surface of conductive front filter housing over the substantially entire surface area thereof. The filtering device preferably comprises a disc capacitor. Conductive rear portion 3 presses against the side of filtering device 2 remote from front filter housing 1. Preferably, conductive rear portion 3 comprises a spring washer which urges filtering device 2 toward front filter housing 1.

Grounding washer 6 is provided so that the adapter can be connected to the electrical connector. Grounding washer 6 has a rear face adapted to contact non-conductive rear filter housing 4; the electrical connector passing through grounding washer 6 while establishing electrical continuity therewith. Front filter housing 1 is formed over rear filter housing 4 captivating the flange of grounding washer 6 sandwiching therebetween filtering device 2 and conductive rear portion 3. This entire assembly can be manufactured and shipped as a single unit which can be simply inserted over the connector by a customer.

Each of front filter housing 1, filtering device 2, and conductive rear portion 3 are formed with a opening therethrough which matches that of grounding washer 6. The threaded portion of the connector passes through the filter adaptor to connect with the panel of the external device. To complete the isolation of the connector from the panel, insulating washer 5, adapted to surround the portion of the electrical connector that passes through the opening, and the area surrounding the hole in the panel through which the connector passes, is supplied. When the electrical connector is passed through the adapter of the invention, insulating washer 5 is then inserted from the internal side of the mounting panel of the external device after which the connector is attached using a lock washer and nut, in the same manner as the conventional connector described above.

Front filter housing 1 is isolated from rear portion 3 and grounding washer 6 by non-conductive rear filter housing 4. Thus, RF signals received from the panel of the external device to which the connector is mounted can only pass to conductive rear portion 3 and grounding washer 6 through filtering device 2. Insulating washer 5 prevents the electrical connector itself from transmitting ground currents from the panel to grounding washer 6. The filter assembly does not, in any manner, interfere with the direct connection of the center conductor of the cable.

Preferably, non-conductive rear filter housing 4 is formed of a plastic material, while the conductive portions of the adapter are formed of a conductive metal. Because the contact area between filtering device 2 and front filter housing is great, the filtering action of the filtering device can be applied to a much higher bandwidth. The use of a spring washer as conductive rear portion 3 allows the adapter to compensate for dimensional tolerances and ensure that contact between front filter housing 1 and filtering device 2 is over the entire 360° surface area. This full contact maximizes the capacitance of the filtering device, and optimizes the filtering action thereof. The inventive adapter thus supplies optimal RF filtering, as well as full DC isolation of the connector from the panel of the external device to which it is mounted.

Of course, although the invention has been described in conjunction with RF-type cables, clearly, the inventive filter assembly could be easily adapted to, for example, reduce the effects of EMI in such applications as computers. Further, while only the fundamental novel features of the invention as applied to a preferred embodiment thereof have been shown and described, it is understood that various omissions, substitutions, and changes in the form and details of the device illustrated and in its operation, may be made by those skilled in the art without departing from the spirit of the invention. It is therefore the intention of Applicants that the invention be limited only as indicated by the scope of the claims appended hereto.

We claim:

1. An adapter for filtering signals between an electrical connector and a panel mounted receiving connector of an external device, and providing DC isolation therebetween, said adapter comprising;

a conductive front filter housing having a first surface, adapted to contact a chassis of said external device, and a second surface, a filtering device adapted to contact said second surface of said conductive front filter housing over substantially all of said second surface, a conductive rear portion adapted to press against a side of said filtering device remote from said front filter housing, a grounding washer for electrically connecting said adapter to said electrical connector, each of said front filter housing, filtering device, rear portion, and grounding washer having a matching opening therein through which said electrical connector can pass; a non-conductive rear filter housing, for supporting said front filter housing and said grounding washer, and sandwiching therebetween said conductive rear portion and said filter device whereby said front filter housing is electrically isolated from said grounding washer, and an isolating washer adapted to surround a portion of said electrical connector that passes through said opening.

2. The adapter of claim 1 wherein said conductive rear portion comprises a spring washer adapted to urge said filtering device towards said front filter housing.

3. The adapter of claim 1 wherein said filtering device comprises a disc capacitor.

4. The adapter of claim 1 wherein said front filter housing, said rear portion, and said grounding washer, are formed from an electrically conductive metal.

5. The adapter of claim 1 wherein said rear filter housing is formed from an electrically insulative plastic.

6. The adapter of claim 1 wherein said front filter housing is formed over said rear filter housing captivating a flange of said grounding washer and sandwiching therebetween said filtering device and said conductive rear portion, whereby said adapter, except for said insulating washer, can be supplied as a single unit.

* * * * *